US006018156A

United States Patent [19]

Hong et al.

[11] Patent Number: 6,018,156

[45] Date of Patent: Jan. 25, 2000

[54] MICROWAVE OVEN HAVING IMPROVED STRUCTURE FOR EXTRACTING POWER SUPPLY CORD

[75] Inventors: Suk-won Hong; Hwa-gyu Reo, both of Suwon, Rep. of Korea

[73] Assignee: Samsung Electronics Co., Ltd., Suwon, Rep. of Korea

[21] Appl. No.: 09/207,036

[22] Filed: Dec. 8, 1998

[30] Foreign Application Priority Data

May 13, 1998 [KR] Rep. of Korea ..... 98-17105
May 13, 1998 [KR] Rep. of Korea ..... 98-17109

[51] Int. Cl.[7] ..... H05B 6/80

[52] U.S. Cl. ..... 219/685; 219/756

[58] Field of Search ..... 219/756, 757, 219/685

[56] References Cited

U.S. PATENT DOCUMENTS

| | | | |
|---|---|---|---|
| 4,282,416 | 8/1981 | White | 219/756 |
| 4,284,880 | 8/1981 | Keiser | 219/415 |
| 4,549,054 | 10/1985 | Aoyama | 219/685 |
| 5,369,255 | 11/1994 | Sherer et al. | 219/725 |
| 5,818,015 | 10/1998 | Lee et al. | 219/756 |
| 5,874,714 | 2/1999 | Sik | 219/685 |

FOREIGN PATENT DOCUMENTS

| | | |
|---|---|---|
| 60-251319 | 12/1985 | Japan . |
| 63-186095 | 11/1988 | Japan . |
| 1-106096 | 7/1989 | Japan . |

*Primary Examiner*—Philip H. Leung
*Attorney, Agent, or Firm*—Burns, Doane, Swecker & Mathis, L.L.P.

[57] ABSTRACT

Disclosed is a microwave oven comprising a body divided into a cooking chamber and a device chamber, a heater installed at an upper portion of the cooking chamber, a magnetron installed in the device chamber of the body, a high voltage condenser and a high voltage transformer, and a power supply cord for supplying electric power to the components installed in the cooking chamber and the device chamber. The power supply cord is extracted out of the body through an opening formed at a bottom panel of the body. The power supply cord is extracted through the opening formed at the bottom panel of the body. Thus, the damage of the power supply cord due to the heat of the rear panel of the body which is heated by the heater is prevented.

2 Claims, 5 Drawing Sheets

MICROWAVE OVEN HAVING IMPROVED STRUCTURE FOR EXTRACTING POWER SUPPLY CORD

BACKGROUND OF THE INVENTION

1. Field of the Invention

The present invention relates to a microwave oven, and more particularly to a microwave oven having an improved structure wherein a power supply cord is extracted through a bottom surface thereof.

2. Description of the Prior Arts

Generally, a microwave oven is an appliance for cooking a food by employing a microwave of high frequency. The microwave oven is popular these days for its advantage that it cooks the food in a relatively short time while maintaining the original shape of the cooked object.

Structure of the microwave oven is briefly described with reference to FIG. 1.

As shown, a body 10 of the microwave oven constructed with a plurality of panels has a cooking chamber 10*a* and a device chamber 10*b*.

The cooking chamber 10*a* is a space that a food is received and cooked therein. A rotatable tray 21 is positioned at the bottom of the cooking chamber 10*a*. During the cooking operation, the rotatable plate 21 is rotated by a rotating motor (not shown) installed at a lower portion thereof. A heater (not shown) for performing a baking, roasting, heating, etc. is also installed at an upper portion of the cooking chamber 10*a*.

The device chamber 10*b* is installed with a magnetron 32 for producing a microwave required for cooking the food, a high voltage transformer 23 for applying a high voltage to the magnetron 22, a high voltage condenser 24, and so on. In addition, a cooling fan 25 for cooling the heat of above components is fixed on a rear panel 11 of the body 10 which defines a device chamber 10*b*.

In addition, the cooking chamber 10*a* is installed with a door 30 for opening/closing the cooking chamber 10*a* on a front thereof, and the device chamber 10*b* is installed with a control panel 40 for inputting cooking and operational conditions on a front thereof.

Meanwhile, components installed within the cooking chamber 10*a* and the device chamber 10*b* are operated by a power supplied through a filter section 26 which is connected with a power supply cord 27.

The filter section 26 functions to block the microwave of high frequency not to outflow through the power supply cord 27. Another function of the filter section 26 is that it filters unadjusted electric current flowing into the inner portion of the microwave oven through the power supply cord 27.

Conventionally, the filter section 26 is positioned at an upper side of the cooling fan 25, and accordingly, the power supply cord 27 connected therewith is extracted out through the upper rear side of the body 10 as shown in FIG. 2.

More specifically, the body 10 is installed with a bushing 28 having an opening at a upper side of the rear panel 11, and the power supply cord 27 is extracted outside the body 10 from the filter section 26 through the opening of the bushing 28. The bushing 28 is made of a nonconducting substance so that it is not damaged by the heat of the rear panel 11 during the cooking operation.

The conventional microwave oven having such a structure that the power supply cord is extracted out through the upper side of the rear panel, however, has drawbacks as follows.

Since the area which the power supply cord is extracted through, i.e., the bushing is a nonconductor of the heat, it is not damaged from the heat of the rear panel which is heated during the cooking operation. However, the problem arises in that some portion of the power supply cord which is extracted out extends down along the rear panel. Thus, when the extracted part of the power cord comes in contact with the heated rear panel, the power supply cord can be damaged from the heat thereof.

Moreover, the power supply cord is merely connected with the filter section through the opening of the bushing. Accordingly, if physical force is exerted to the power supply cord, the latter may be easily pulled out from the filter section.

SUMMARY OF THE INVENTION

Accordingly, it is an object of the present invention to prevent the power supply cord from being in contact with the rear panel of the body by improving the extracting structure of a power supply cord.

Another object of the present invention is to provide an improvement to the extracting structure of the power supply cord, which prevent the power supply cord from being pulled out from the filter section even though a strong force is applied thereto.

In order to achieve above objects, the present invention provides a microwave oven comprising: a body divided into a cooking chamber and a device chamber; a heater installed at an upper portion of said cooking chamber; a magnetron installed in said device chamber of said body, said magnetron for producing microwave; a high voltage condenser and a high voltage transformer; and a power supply cord for supplying electric power to the components installed in said cooking chamber and said device chamber, wherein said power supply cord is extracted out of said body through an opening formed at a bottom panel of said body.

Another object of the present invention is achieved by installing a member for clamping said power supply cord. The clamping member comprises a clamping section for clamping said power supply cord, and a fixing section for fastening said clamping section onto the bottom panel of said body.

Furthermore, a bushing is disposed between the opening formed at the bottom panel of said body and said power supply cord extracted therethrough. A lower end of said bushing rests on a support surface so that the bushing functions as a foot for supporting the body, and the opening is formed at a circumference of said bushing.

According to the present invention, the power supply cord is extracted through the opening formed at the bottom panel of the body. Thus, the damage of the power supply cord due to the heat of the rear panel of the body which is heated by a heat is prevented. Furthermore, since the clamping member installed at the upper part of the opening firmly clamps the power supply cord, the power supply is not disconnected by the outside force.

BRIEF DESCRIPTION OF THE DRAWINGS

The above object and other advantages of the present invention will become more apparent by describing in detail a preferred embodiment thereof with reference to the attached drawings, in which.

DESCRIPTION OF THE PREFERRED EMBODIMENT

Hereinafter, the preferred embodiment of the present invention will be described in greater detail with reference to the accompanying drawings.

Figure 1:
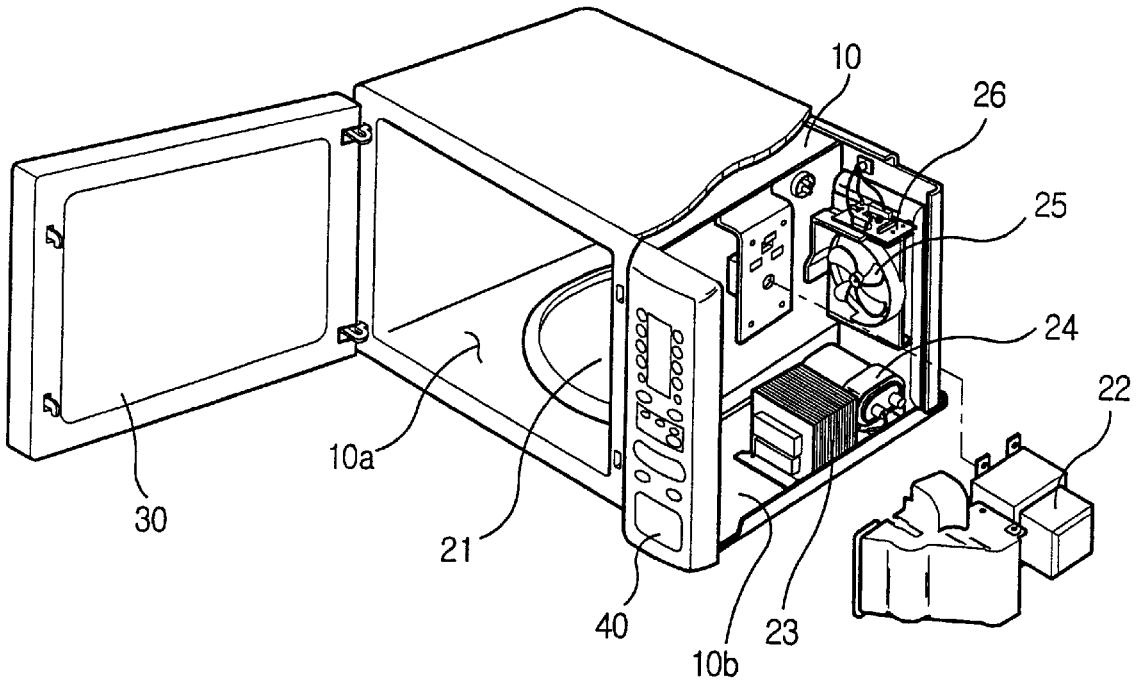
FIG. 1 (PRIOR ART)
FIG. 1 is a perspective view showing a conventional microwave oven.
Figure 2:
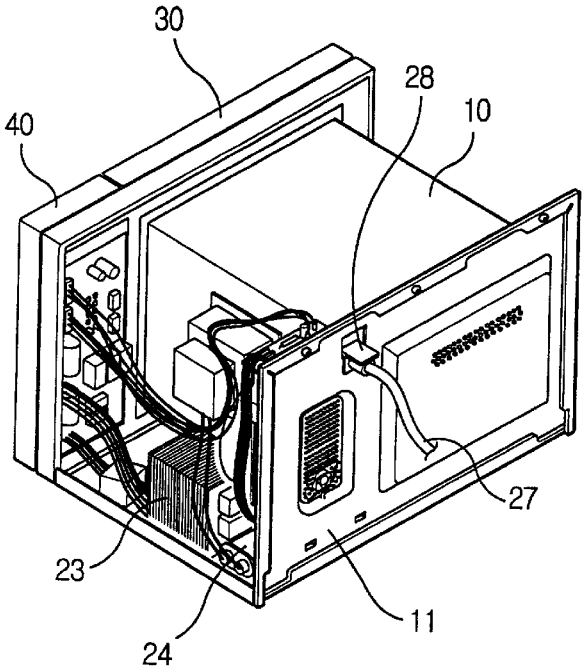
FIG. 2 (PRIOR ART)
FIG. 2 is a perspective view showing a conventional microwave oven shown in FIG. 1, which is viewed from another position.

The basic constitution of the microwave oven of the present invention is identical with that of the conventional microwave oven shown in FIG. 1. Therefore, description of the same part will be skipped, and attentions are now invited only to a main part of the present invention, a power supply extracting structure.

Figure 3:
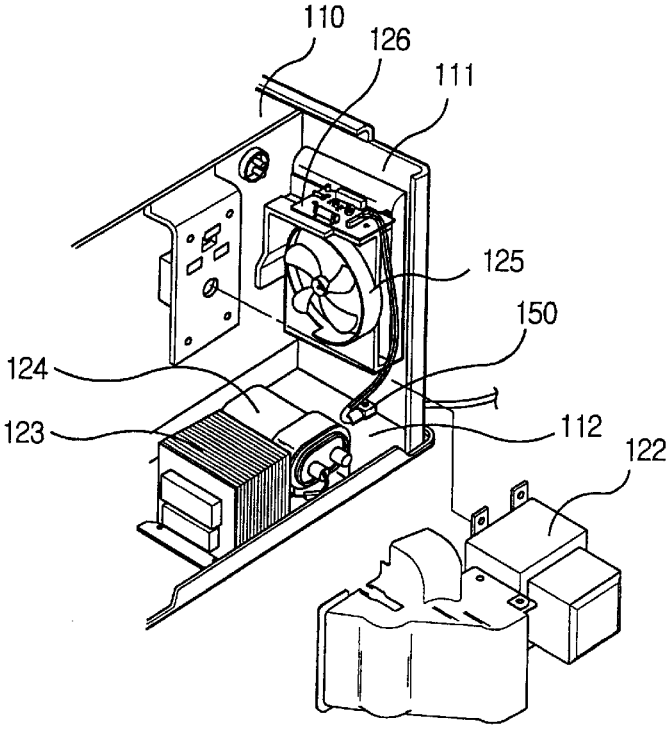
FIG. 3 is a perspective view showing a microwave oven according to the first embodiment of the present invention.
Figure 4:
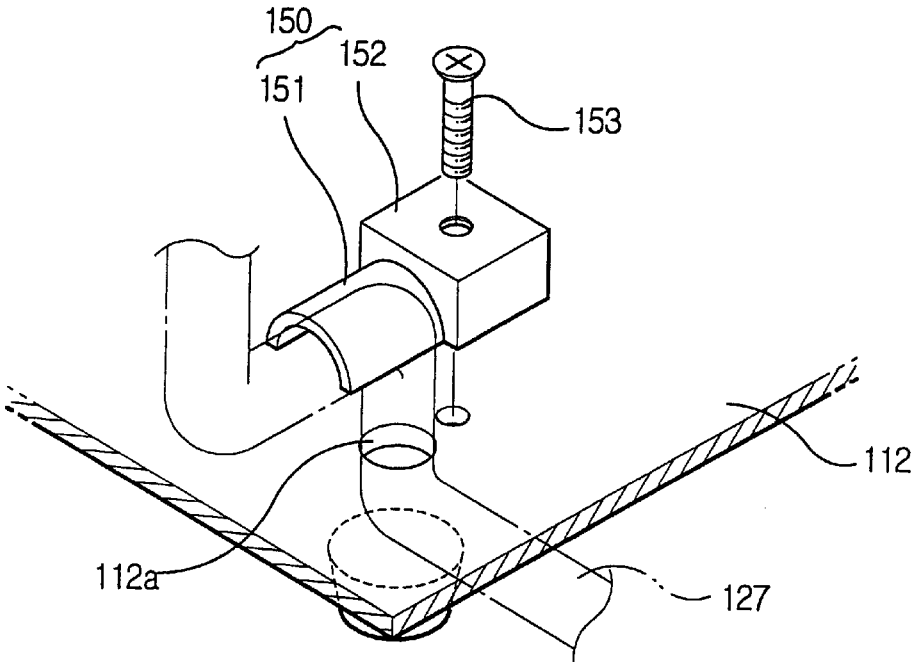
FIG. 4 is an exploded perspective view showing a main part of FIG. 3 in greater detail.
Figure 5:
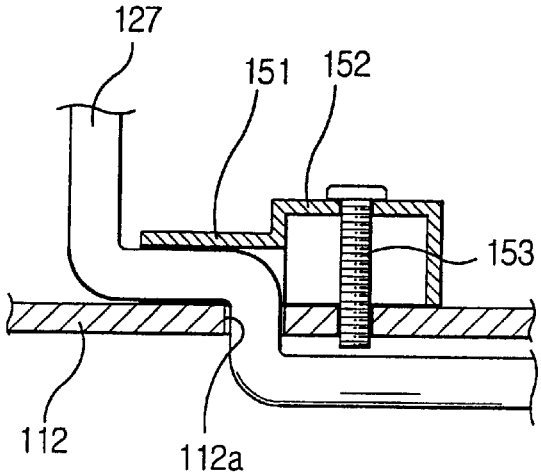
FIG. 5 is a vertical sectional view showing the assembled state of FIG. 4.

FIGS. 3 through 5 show a power supply extracting structure according to the first preferred embodiment of the present invention.

According to the first embodiment of the present invention, a body 110 is formed with an opening 112*a* at a bottom panel 112 thereof, through which a power supply cord 127 is extracted out. Accordingly, the power supply cord 127 connected with a filter section 126 passes through the opening 112*a* and then finally extracted out toward a lower portion of the bottom panel 112.

The bottom panel 112 is installed with a clamping member 150 at an upper side of the opening 112*a* thereof.

The clamping member 150 includes a clamping section 151 and a fixing section 152. The clamping section 151 has a downwardly falling clamping face of semi-cylindrical shape, and the inner diameter thereof is identical to a diameter of the power supply cord 127. The fixing section 152 is fastened onto the bottom panel 112 of the body 110 by a bolt 153.

When the bolt 153 is assembled with the fixing section 152, the clamping section presses the power supply cord 127 downward against an upper surface of the bottom panel, and thereby the power supply cord 127 is clamped so as to be fixed.

As described, the power supply cord 127 is extracted out to the underside of the bottom panel 112 of the body 110 through the opening 112*a* formed at the bottom panel 112.

Figure 6:
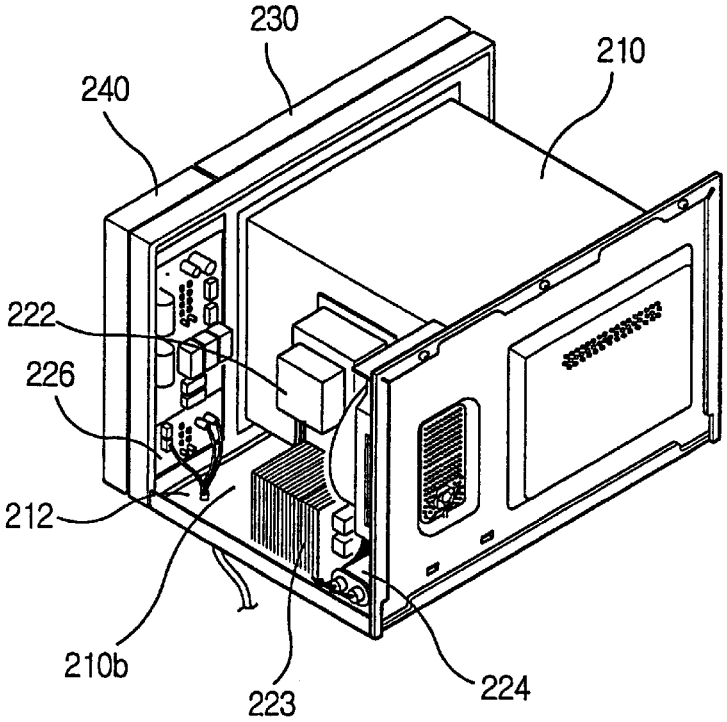
FIG. 6 is a perspective view showing the main part of a microwave oven according to the second embodiment of the present invention.
Figure 7:
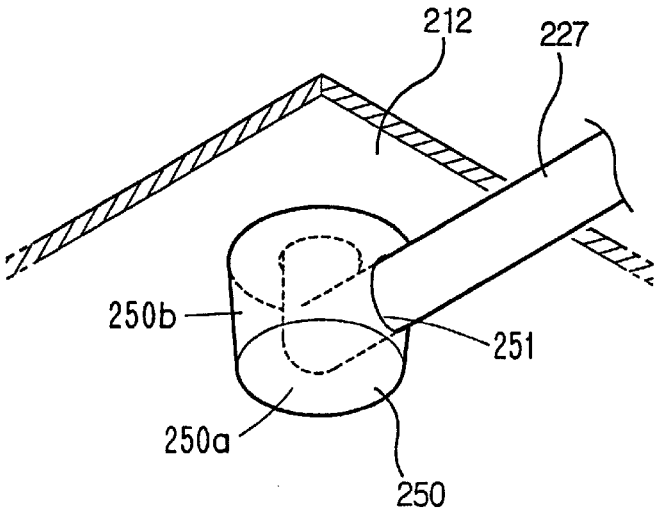
FIG. 7 is a perspective view of main part of FIG. 6 viewed from the bottom side.
Figure 8:
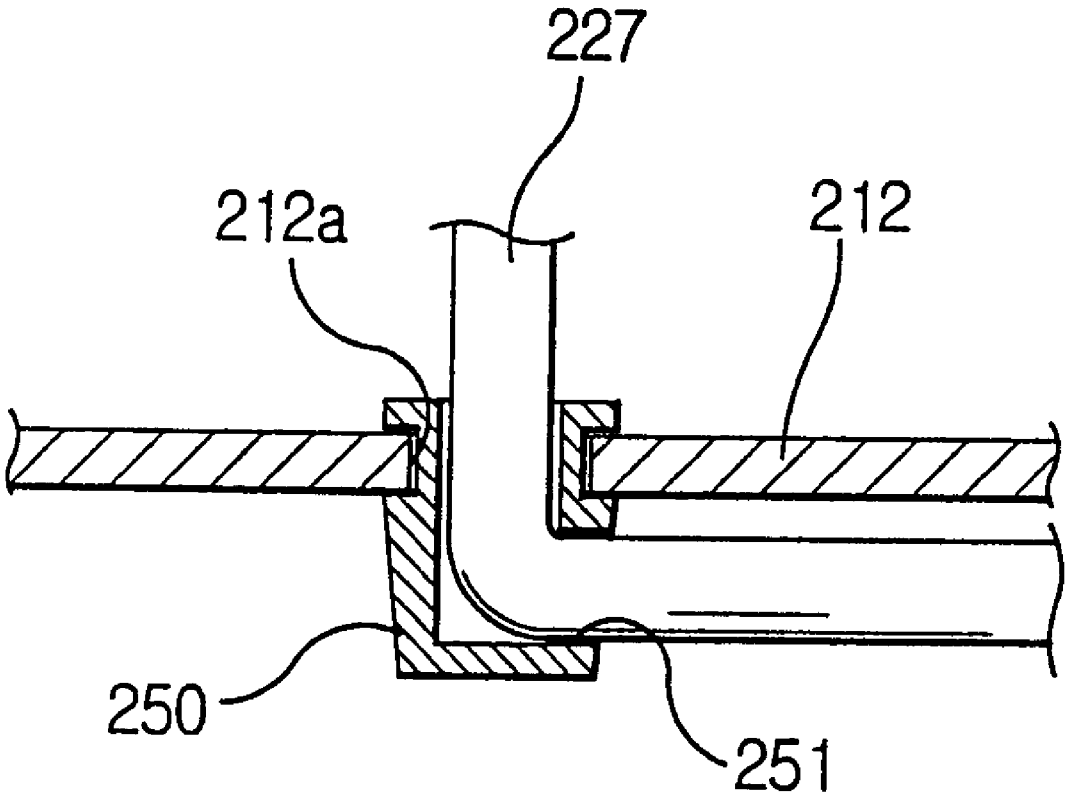
FIG. 8 is a vertical sectional view of FIG. 7.

Meanwhile, FIGS. 6 through 8 show a second embodiment of the present invention.

According to the second preferred embodiment of the present invention, the opening 212*a* for extracting the power supply cord 227 is formed at the bottom panel 212 of the body 210. Accordingly, the power supply cord 227 connected with the filter section 226 is extracted out through the bottom panel 212 of the body 210.

A bushing 250 is inserted into the opening 212*a*. The lower face 250*a* of the bushing 250 rests upon the support surface on which the microwave oven stands, so the bushing 250 functions as a foot for supporting the microwave oven.

In addition, as the bushing 250 rests on the support surface, the power supply cord 227 is extracted out through a passage formed in the bushing, the passage intersecting the circumferential side face 250*b* of the bushing to form an opening 251.

Since the bushing 250 functions as the foot to the microwave oven as described above, the bushing 250 is disposed at the position where the usual foot would be installed, the bushing acts as a substitute for the usual foot. To this end, it is preferable that the filter section 226 which distributes the electric power supplied through the power supply cord 227 to the components in the device chamber 210*b* and the cooking chamber is installed at a rear surface of a control panel 240 which is positioned on the front of the device chamber 210*b*.

According to the present invention described as above, the power supply cord is extracted out through the opening formed at the bottom panel of the body toward the lower side of the bottom panel. Accordingly, the power supply cord is prevented from being contacted with the rear panel of the body, so the damage of the power supply cord is prevented.

In addition, according to the first preferred embodiment of the present invention, since the clamping member installed at an upper portion of the opening firmly clamps the power supply cord, the power supply cord is prevented from being pulled out even though a strong force is applied to the power supply cord.

Also, according to the second preferred embodiment of the present invention, since the bushing installed between the opening of the bottom panel and the power supply cord functions as both a bushing and a foot of the microwave oven, the number of components is reduced, and thereby the manufacturing cost can be lowered.

While the present invention has been particularly shown and described with reference to a preferred embodiment thereof, it will be understood by those skilled in the art that various changes in form and detail may be effected therein without departing from the spirit and scope of the invention as defined by the appended claims.

What is claimed is:

1. A microwave oven comprising:

a body divided into a cooking chamber and a device chamber, said body including a bottom panel having an opening extending downwardly therethrough;

a heater installed at an upper portion of said cooking chamber;

a magnetron installed in said device chamber of said body for producing microwaves;

a high voltage condenser and a high voltage transformer installed in said device chamber for supplying a high voltage to said magnetron;

a power supply cord for supplying electric power to the heater, the high voltage condenser, and the high voltage transformer; and a clamping member installed on an upper side of said bottom panel, adjacent to said opening, said clamping member including a fixing section fixed to said bottom panel, and a clamping section including a downwardly facing semi-circular clamping face for clamping the power supply cord against said upper surface, said semi-circular clamping face having a diameter corresponding to that of said power supply cord.

2. A microwave oven comprising:

a body divided into a cooking chamber and a device chamber, said body including a bottom panel having an opening extending downwardly therethrough;

a heater installed at an upper portion of said cooking chamber;

a magnetron installed in said device chamber of said body for producing microwaves;

a high voltage condenser and a high voltage transformer installed in said device chamber for supplying a high voltage to said magnetron;

a power supply cord for supplying electric power to the heater, the high voltage condenser, and the high voltage transformer; and a plurality of support feet projecting downwardly from said body and including respective lower faces for resting on a support surface, one of said support feet having a passage extending therethrough, one end of said passage facing upwardly and communicating with said opening in said bottom panel, another end of said passage intersecting a side face of said one foot at a location above said lower face, said power supply cord extending through said passage.

* * * * *